US009399357B2

(12) United States Patent
Ishino et al.

(10) Patent No.: US 9,399,357 B2
(45) Date of Patent: Jul. 26, 2016

(54) PRINTING DEVICE, CONTROL METHOD OF A PRINTING DEVICE, AND A STORAGE MEDIUM

(71) Applicant: Seiko Epson Corporation, Tokyo (JP)

(72) Inventors: Hitoshi Ishino, Shimosuwacho (JP); Hideki Furihata, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/790,486

(22) Filed: Jul. 2, 2015

(65) Prior Publication Data

US 2016/0001574 A1 Jan. 7, 2016

(30) Foreign Application Priority Data

Jul. 7, 2014 (JP) ..... 2014-139410
Jun. 15, 2015 (JP) ..... 2015-119990

(51) Int. Cl.
*B41J 2/32* (2006.01)
*B41J 2/355* (2006.01)

(52) U.S. Cl.
CPC *B41J 2/3551* (2013.01); *B41J 2/32* (2013.01); *B41J 2/3558* (2013.01); *B41J 2/355* (2013.01)

(58) Field of Classification Search
CPC ..... B41J 2/3551
See application file for complete search history.

(56) References Cited

U.S. PATENT DOCUMENTS 4,875,056 A * 10/1989 Ono ..... B41J 2/355 347/180
5,786,842 A * 7/1998 Awai ..... B41J 17/32 347/215
2005/0219345 A1* 10/2005 Muto ..... B41J 2/355 347/180
2010/0253758 A1 10/2010 Mito
2013/0258028 A1 10/2013 Matsutani

FOREIGN PATENT DOCUMENTS

JP 07-223329 A 8/1995
JP 07-314760 A 12/1995
JP 08-25672 A 1/1996
JP 2008-155563 A 7/2008
JP 2013-208737 A 10/2013

* cited by examiner

*Primary Examiner* — Lisa M Solomon

(57) ABSTRACT

The temperature of heat elements of a thermal head can be controlled with high precision by a process with a low processor load. A printer 100 that prints on thermal roll paper 102 based on print data has a thermal head 134 with multiple heat elements 136 arrayed in a sub-scanning direction CR perpendicular to the conveyance direction F of the thermal roll paper 102. The printer 100 has a current control unit 112 that segments the heat elements of the thermal head 134 into plural blocks, and controls the energize timing of the heat elements in each block based on the number of heat elements 136 that are energized in the thermal head 134.

12 Claims, 7 Drawing Sheets

| BATTERY VOLTAGE | NUMBER OF SIMULTANEOUSLY ENERGIZED DOTS |
|---|---|
| 8.0V | 200dot |
| 7.5V | 150dot |
| 7.0V | 100dot |

FIG. 6

PRINTING DEVICE, CONTROL METHOD OF A PRINTING DEVICE, AND A STORAGE MEDIUM

BACKGROUND

1. Technical Field

The present invention relates to a printing device, a control method of a printing device, and a storage medium.

2. Related Art

Printing devices (printers) that print by using a thermal head to apply heat energy to thermal paper used as the print medium or to hot melt ink are known from the literature. A problem with this type of printer is that when the print speed is fast and the print cycle short, it is difficult to sufficiently increase the temperature of the heat elements.

JP-A-2013-208737 addresses this problem with a printer that applies pulses selectively to the heat elements of the thermal head to produce heat, and enables high density printing by using heat elements that are short in the conveyance direction of the print medium and applying multiple pulses to the heat elements.

However, a voltage drop occurs when driving the heat elements due to such constraints as the capacity of the power supply circuit. The pulse width must therefore be adjusted with consideration for the voltage drop in order to control the temperature of the heat elements with high precision, and this creates a heavy data processing load.

SUMMARY

The present invention enables controlling the temperature of the heat elements of the thermal head with high precision by means of a process with a light load on the processor.

One aspect of the invention is a printing device that prints on print media based on print data, and has: a thermal head having multiple heat elements with the heat elements arrayed in a direction perpendicular to the conveyance direction of the print medium; and a control unit that divides the thermal head into plural blocks and controls the energize timing of the heat elements in each block based on the number of heat elements energized among the heat elements of the thermal head.

Thus comprised, the printing device controls dividing the heat elements of the thermal head into plural blocks and the energize timing of the heat elements. As a result, a control method that suppresses the number of simultaneously energized heat elements by applying current in block units does not need to adjust the energize timing block by block, and control can be simplified. The processor load can therefore be reduced, delays from processing can be prevented, and throughput can be improved.

Preferably, the control unit divides the thermal head into plural blocks so that the difference in the number of heat elements that are energized in a first block and a second block included in the plural blocks is less than a specific value.

This aspect of the invention simplifies controlling the energize timing, and reduces the processor load.

Further preferably, the control unit segments the heat elements into blocks so that the difference in the heat output per unit time between the first block and the second block is less than a specific value.

This aspect of the invention further simplifies controlling the energize timing because the difference in heat output between blocks is small.

Further preferably, the printing device also has a battery; and the control unit segments the thermal head into blocks based on at least one of a voltage of the battery and a temperature of the battery.

Thus comprised, the heat elements can be grouped in blocks based on the condition of the battery.

In a printing device according to another aspect of the invention, the control unit segments the thermal head into blocks based on at least one of the voltage applied to the heat elements, the conveyance speed of the print medium, and the temperature of the heat elements.

Thus comprised, the heat elements can be grouped in blocks based on the energizing state of the heat elements.

Further preferably, the printing device also has a battery management unit that detects at least one of the remaining battery capacity and the ambient temperature of the battery; and a drive unit that applies pulse current to the heat elements in block units based on the current output of the battery.

Thus comprised, energizing the heat elements can be appropriately controlled and consistent printing is possible even when the amount of power supplied to the heat elements is limited by the capacity of the battery.

Further preferably, the control unit determines the number of blocks based on the detector output of the battery management unit, and the number of heat elements energized among the heat elements of the thermal head.

Thus comprised, energizing the heat elements can be appropriately controlled by a process with an even lower processor load.

In a printing device according to another aspect of the invention, the thermal head is a line head having heat elements equal to at least one dot line printed on the print medium; a line buffer stores at least one dot line of print data in dot line units; and the control unit identifies which of the heat elements of the thermal head are energized based on the print data stored in the line buffer.

Thus comprised, which of the heat elements in the line head are energized to print can be quickly determined, and the heat elements can be efficiently grouped into blocks. As a result, blocks can be created appropriately to the data to print, and high quality printing can be achieved.

Another aspect of the invention is a control method of a printing device having a thermal head with multiple heat elements arrayed in a direction perpendicular to the conveyance direction of the print medium, and printing on the print medium based on print data, including: controlling dividing the thermal head into plural blocks and controlling the energize timing of the heat elements in each block based on the number of heat elements energized among the heat elements of the thermal head.

Thus comprised, the printing device controls dividing the heat elements of the thermal head into plural blocks and the energize timing of the heat elements. As a result, a control method that suppresses the number of simultaneously energized heat elements by applying current in block units does not need to adjust the energize timing block by block, and control can be simplified. The processor load can therefore be reduced, delays from processing can be prevented, and throughput can be improved.

In a control method of a printing device according to another aspect of the invention, the printer preferably divides the thermal head into plural blocks so that the difference in the number of heat elements that are energized in a first block and a second block included in the plural blocks is less than a specific value.

This aspect of the invention simplifies controlling the energize timing, and reduces the processor load.

In a control method of a printing device according to another aspect of the invention, the printer segments the heat elements into blocks so that the difference in the heat output per unit time between the first block and the second block is less than a specific value.

This aspect of the invention further simplifies controlling the energize timing because the difference in heat output between blocks is small.

In a control method of a printing device according to another aspect of the invention, the printer also applies pulse current to the heat elements in block units based on the current output of the battery; and segments the thermal head into blocks based on at least one of a voltage of the battery and a temperature of the battery.

Thus comprised, energizing the heat elements can be appropriately controlled and consistent printing is possible even when the amount of power supplied to the heat elements is limited by the capacity of the battery.

In a control method of a printing device according to another aspect of the invention, the printer segments the heat elements of the thermal head into blocks based on at least one of the voltage applied to the heat elements, the conveyance speed of the print medium, and the temperature of the heat elements.

Thus comprised, the heat elements can be grouped in blocks based on the energizing state of the heat elements.

Another aspect of the invention is a program enabling a control unit that controls a printing device to execute the control method of the printing device described above.

The invention can also be embodied as a storage medium storing the program.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 6 is used to describe the process that divides the thermal head into blocks.

DESCRIPTION OF EMBODIMENTS

A preferred embodiment of the present invention is described below with reference to the accompanying figures.

Figure 1:
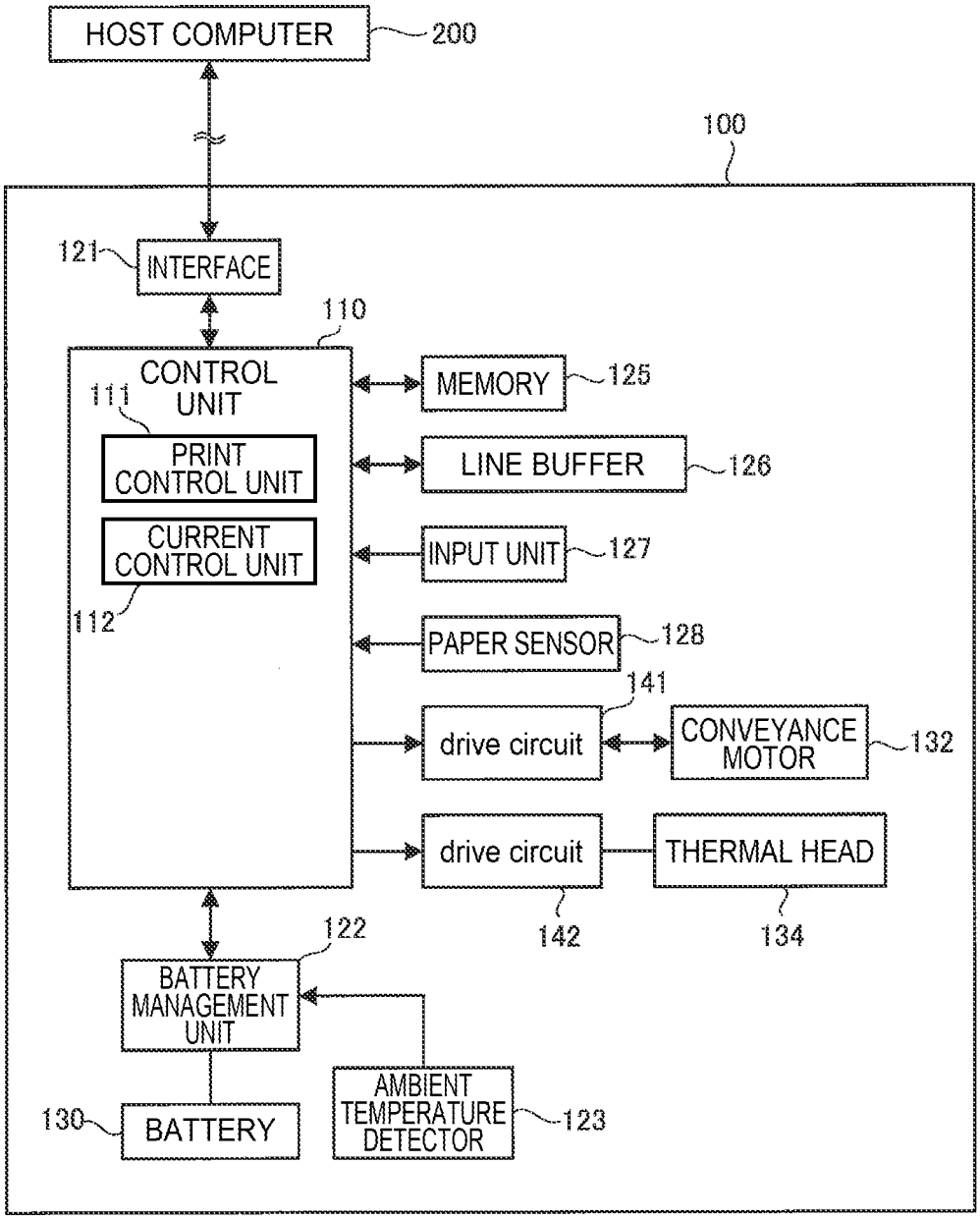
FIG. 1 is a function block diagram of a printer according to a preferred embodiment of the invention.

FIG. 1 is a function block diagram of a printer 100 according to this embodiment of the invention.

The printer 100 is a mobile printer that houses a battery 130 in a compact portable case, and operates with the battery 130 as the power supply.

The printer 100 has a control unit 110 that controls other parts of the printer 100. Connected to the control unit 110 are an interface 121, battery management unit 122, memory 125, line buffer 126, input unit 127, paper sensor 128, drive circuit 141, and drive circuit 142. The printer 100 also has a conveyance motor 132 driven by a drive circuit 141, and a thermal head 134 driven by a drive circuit 142.

Figure 2:
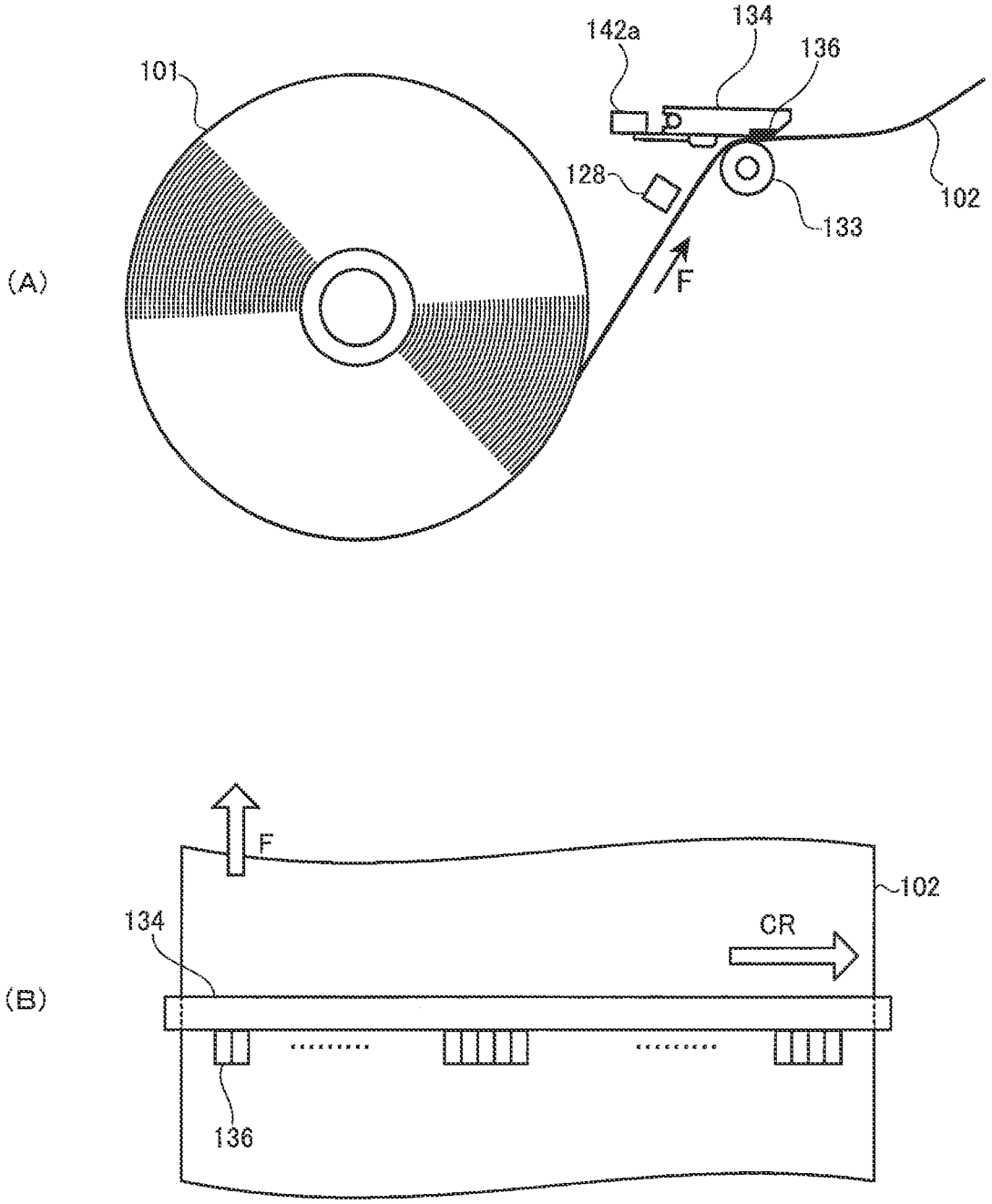
FIG. 2 schematically illustrates main parts of the printer.

FIG. 2 schematically illustrates the main parts of the printer 100. FIG. 2 (A) is a side view of the conveyance path of the thermal roll paper 102, and (B) is a plan view of the thermal head 134 and thermal roll paper 102.

As shown in FIG. 2 (A), the printer 100 uses thermal roll paper 102 having continuous thermal paper used as the recording medium wound into a roll. In addition to thermal roll paper 102, the printer 100 can also use label paper cut to a specific size as the print medium. Such label paper has thermal paper labels cut to a specific size and coated with adhesive on the back affixed to a continuous web and wound into a roll.

A paper roll 101 of thermal roll paper 102 is stored inside the cabinet (not shown in the figure) of the printer 100. The printer 100 has a platen 133 and thermal head 134 disposed above the conveyance path of the thermal roll paper 102.

The thermal head 134 applies heat energy to the printing surface of the thermal roll paper 102 to produce color and print text and images. The platen 133 is a cylindrical platen roller, is connected through a gear train not shown to the conveyance motor 132 (FIG. 1), and turns in conjunction with rotation of the conveyance motor 132. The platen 133 is disposed opposite the thermal head 134. At least one of the platen 133 and thermal head 134 is pushed toward the other by the force of a spring or other urging member (not shown in the figure). As a result, the thermal roll paper 102 is held and conveyed by the platen 133 and thermal head 134 by the pressure of the urging member.

The thermal roll paper 102 is delivered from the paper roll 101, and conveyed between the platen 133 and thermal head 134 in the conveyance direction indicated by arrow F in the figure by the torque from the platen 133. The thermal head 134 prints text and images on the thermal roll paper 102 as it is conveyed. The printed portion of the thermal roll paper 102 is then discharged from the paper exit not shown and cut using a manual cutter (not shown in the figure).

The thermal head 134 has multiple heat elements 136 arrayed on the side that contacts the thermal roll paper 102. As shown in FIG. 2 (B), the heat elements 136 are arrayed across the width of the thermal roll paper 102. For convenience of description below, the example shown in FIG. 2 (B) has the heat elements 136 arrayed in a single line, but heat elements 136 may also be arrayed in plural lines widthwise to the thermal roll paper 102. The direction across the width of the thermal roll paper 102 perpendicular to the conveyance direction F is called the sub-scanning direction indicated by arrow CR in the figure in relation to the conveyance direction F (main scanning direction) of the thermal roll paper 102.

In the simplest example, one heat element 136 forms one dot on the thermal roll paper 102. For example, if the size of the print area in the sub-scanning direction CR is 2 inches, and there are 600 heat elements 136, the print resolution is 300 dpi (dots per inch). Text and images based on the print data are printed on the thermal roll paper 102 by the control unit 110 shown in FIG. 1 individually controlling energizing the heat elements 136.

Referring again to FIG. 1, the interface 121 is connected to a host computer 200 through a communication path, and sends and receives data with the host computer 200 as controlled by the control unit 110. The communication path connecting the interface 121 and host computer 200 may be a wired communication path such as a USB cable, or a wireless communication path such as a wireless LAN, Bluetooth™, or UWB connection.

The memory 125 has a storage area for temporarily storing print data received by the control unit 110. The line buffer 126 is a storage area for rendering one dot-line of print data when the control unit 110 prints the print data.

The memory 125 and line buffer 126 are semiconductor memory devices in this example. The memory 125 and line buffer 126 may be configured using separate storage devices, or one or both of the memory 125 and line buffer 126 may be embodied using RAM of the control unit 110.

The data written to the line buffer 126 indicates whether or not the thermal head 134 forms a black dot for any particular dot that can be formed by the thermal head 134. Each of the heat elements 136 in this embodiment forms one dot. The data written to the line buffer 126 is therefore data determining whether or not a particular heat element 136 forms a black dot.

The input unit 127 is connected to switches on the operating panel (not shown in the figure) of the printer 100, for example. Each time a switch is operated, the input unit 127 generates and outputs an operating signal corresponding to the switch that was operated to the control unit 110.

The paper sensor 128 is an optical sensor that detects whether or not thermal roll paper 102 (FIG. 2) is present at a position on the upstream side of the thermal head 134. The control unit 110 detects if the thermal roll paper 102 has run out by acquiring the output of the paper sensor 128.

The drive circuit 141 is connected to the conveyance motor 132. The drive circuit 141 supplies drive current to the conveyance motor 132 and causes the conveyance motor 132 to turn as controlled by the control unit 110.

The conveyance motor 132 may be a stepper motor, in which case the drive circuit 141 outputs drive pulses and drive current to the conveyance motor 132 as controlled by the control unit 110.

By switching the voltage of the drive current supplied to the conveyance motor 132, the drive circuit 141 can make the conveyance motor 132 turn in a forward direction or a reverse direction. As a result, the thermal roll paper 102 can be conveyed in the conveyance direction F or the opposite of the conveyance direction F as controlled by the control unit 110.

The drive circuit 142 (drive unit) is connected to the thermal head 134. The drive circuit 142 energizes the individual heat elements 136 of the thermal head 134 as controlled by the control unit 110 to change the color of the thermal roll paper 102 at the desired positions in the range of dots that can be printed by the thermal head 134.

The battery management unit 122 is connected to the battery 130, and detects and outputs the voltage of the battery 130 to the control unit 110. The battery management unit 122 is connected to the ambient temperature detector 123. The ambient temperature detector 123 is a temperature detector disposed in the battery compartment (not shown in the figure) where the battery 130 is held, and may be a thermistor or thermocouple, for example. The battery management unit 122 detects the ambient temperature of the battery 130 by the ambient temperature detector 123 and outputs the detected value to the control unit 110. The timing at which the battery management unit 122 detects and outputs the temperature to the control unit 110 may be preset or controlled by the control unit 110.

The battery 130 may be a lithium ion storage battery or a nickel metal hydride storage battery, for example, and supplies power to the parts of the printer 100 shown in FIG. 1. Note that the battery 130 may also be a primary battery or a fuel cell, for example. A configuration that supplies power from the battery 130 to other parts of the printer 100 through a voltage converter (not shown in the figure) that converts the output voltage of the battery 130 is also conceivable.

The control unit 110 comprises CPU, ROM, RAM, and other peripheral circuits not shown, reads and runs a basic control program stored in ROM, and controls other parts of the printer 100. By running this basic control program, the control unit 110 functions as a print control unit 111 and current control unit 112.

The print control unit 111 processes print data using memory 125 and the line buffer 126, and controls the drive circuits 141, 142 to print text and images on the thermal roll paper 102. More specifically, the print control unit 111 stores print data received from the host computer 200 through the interface 121 to memory 125. The print control unit 111 then controls the drive circuit 141 and operates the conveyance motor 132 to convey the thermal roll paper 102. The print control unit 111 reads print data from the memory 125, and renders one dot line of data in the line buffer 126.

The current control unit 112 controls the drive circuit 142 based on the one dot line of data written to the line buffer 126 by the print control unit 111.

Control of the current control unit 112 and the operation whereby the drive circuit 142 energizes the heat elements 136 is described next.

Figure 3:
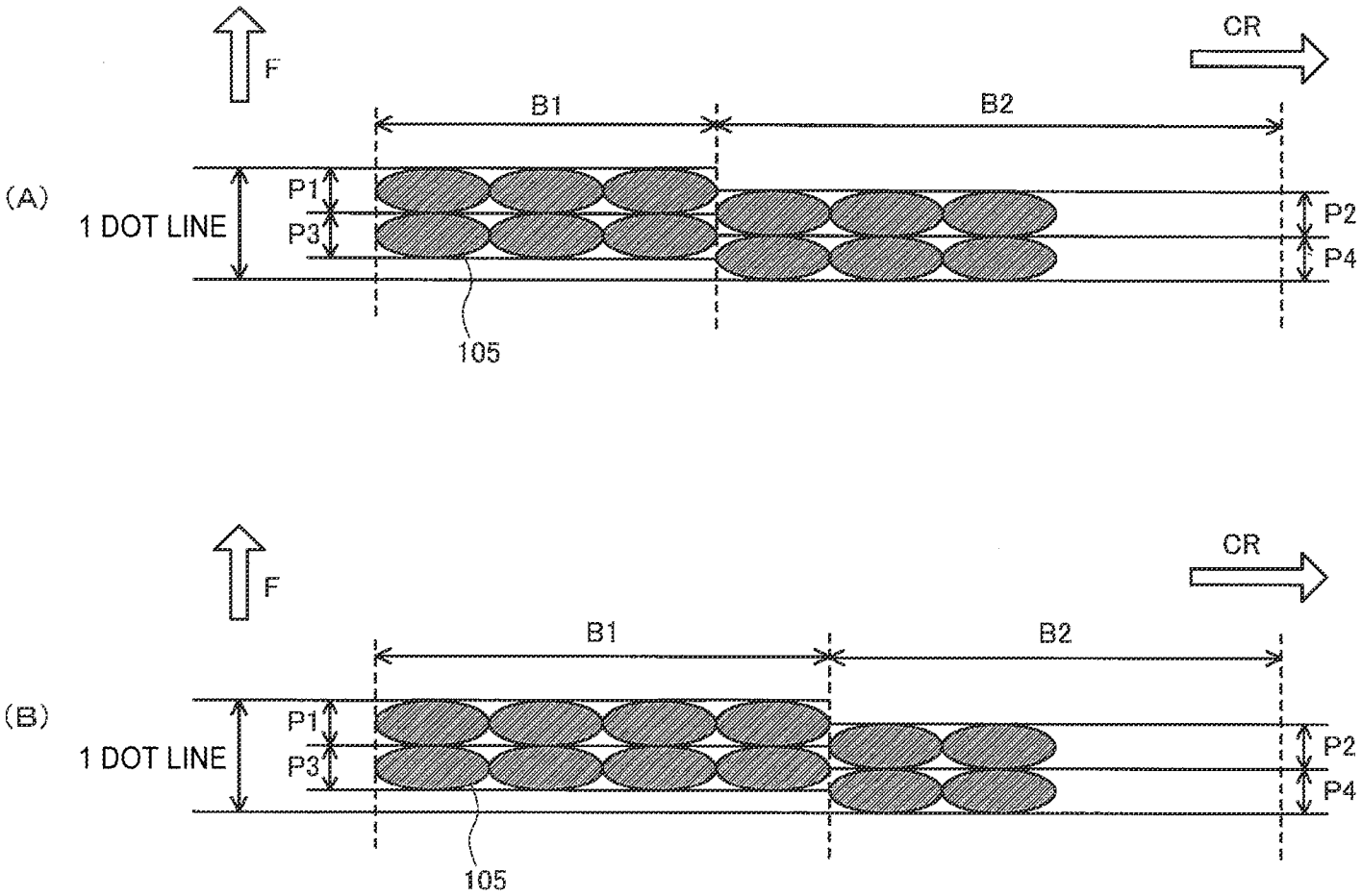
FIG. 3 is used to describe controlling the formation of dots on thermal roll paper.

FIG. 3 describes controlling energizing heat elements to form dot 105 on the thermal roll paper 102, (A) illustrating an example of this embodiment of the invention, and (B) showing a comparison.

Dot 105 in FIG. 3 (A) is a black dot on the thermal roll paper 102 formed by energizing a heat element 136. The drive circuit 142 applies current pulses to the heat elements 136, and one dot 105 is formed when one current pulse is applied to one heat element 136. The dot 105 is an oval dot that is smaller in the conveyance direction F than in the sub-scanning direction CR, and the size of the dot 105 in the main scanning direction F is half the dot line width. As a result, to form a dot the size of one dot line on the thermal roll paper 102, the heat element 136 is driven twice, forming two dots 105. Because the two dots 105 are adjacent in the conveyance direction F, they appear to the naked eye as one dot. In the example shown in FIG. 3 (A), three dots 105 are formed by the first pulse P1, and three dots 105 are formed by the second pulse P3.

The drive circuit 142 uses a segmented drive method that divides the heat elements 136 in one row of the thermal head 134 into blocks, and applies current pulses in block units. In the example shown in FIG. 3 (A), the heat elements 136 are divided into two blocks, block B1 and block B2, pulses P1 and P3 are energized in block B1, and pulses P2 and P4 are energized in block B2. The drive circuit 142 inserts a difference between the timing of the pulses to block B1 and the timing of pulses to block B2. In FIG. 3 (A), the dots on one dot line are formed by pulses P1, P2, P3, P4. Pulse P1 and pulse P2 are both pulses that form first dots 105, but the drive circuit 142 inserts a specific difference between the timing of the start of pulse P1 and the timing of the start of pulse P2. The dots 105 in block B1 formed on the thermal roll paper 102 and the dots 105 in block B2 are therefore formed at different positions in the conveyance direction F.

Figure 4:
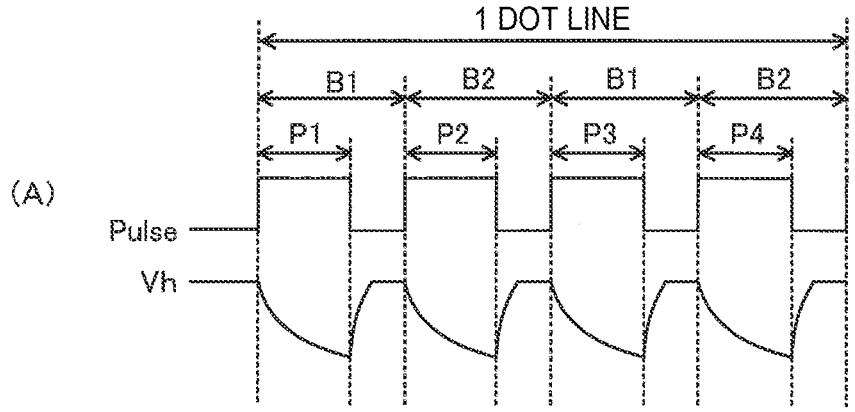
FIG. 4 is a timing chart of changes in the pulse output timing and voltage.
Figure 4:
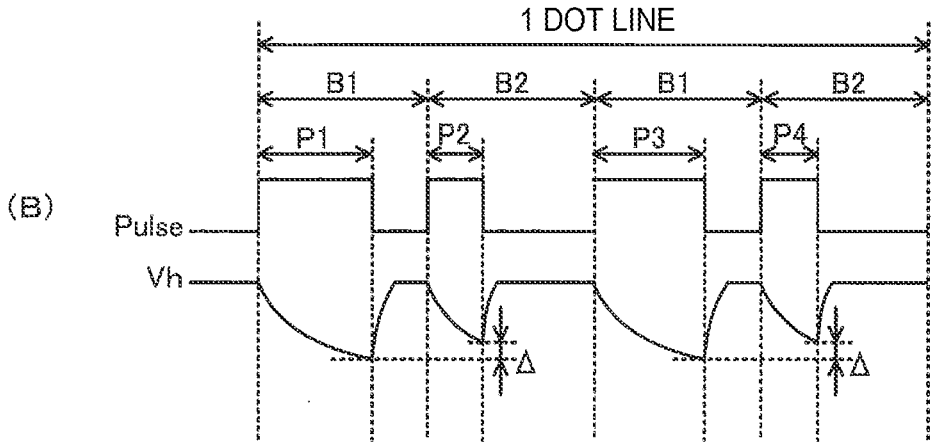

FIG. 4 is a timing chart illustrating the output timing of pulses output to the heat element 136 and the change in voltage, (A) illustrating this embodiment of the invention, and (B) showing a comparison. In FIGS. 4 (A) and (B), Pulse indicates the pulses output by the drive circuit 142, and Vh indicates the drive voltage applied to the heat elements 136.

As shown in FIG. 4 (A), the drive voltage Vh drops when the drive circuit 142 outputs pulse P1, and the drive voltage Vh recovers after the pulse P1 drops. By then outputting pulses P2, P3, P4 at the timing shown in FIG. 3 (A), the heat elements 136 can be heated by a sufficient drive voltage and good dots 105 can be formed.

When the thermal head 134 is segmented into plural blocks, the current control unit 112 must output pulses so that there is no difference in the density of the dots 105 in different blocks. The current control unit 112 therefore controls the timing and pulse width of pulses P1 to P4 based on the number of heat elements 136 in the group of heat elements 136 in one block that produce heat (are energized), the number of blocks in the thermal head 134, and the temperature of the heat elements 136. The temperature of the heat elements 136 may be calculated or estimated from the time past since the previous pulse, or the temperature of the heat element 136 may be detected using a thermistor disposed to the thermal head 134.

In addition to the number of energized heat elements 136, the number of blocks, and the temperature of the heat elements 136, the current control unit 112 may also consider the remaining capacity of the battery 130 detected by the battery management unit 122 to control the timing and pulse width of the pulses P1 to P4. In this event, the current control unit 112 estimates how much power can be supplied to the battery 130 to control the timing and pulse width of the pulses P1 to P4.

Further alternatively, the current control unit 112 may also factor in the ambient temperature of the battery 130 detected by the ambient temperature detector 123 to control the timing and pulse width of the pulses P1 to P4. By factoring in the temperature detected by the ambient temperature detector 123, the timing and pulse width of the pulses P1 to P4 can be more appropriately controlled by also considering temperature characteristics related to the output of the battery 130.

By thus segmenting the thermal head 134 into plural blocks, and offsetting the timing when pulses are applied, good dots 105 can also be formed when the capacity of the battery 130 is low.

When segmenting the thermal head 134 into plural blocks the current control unit 112 in this embodiment of the invention determines the number of blocks and the beginning and end of each block. By the current control unit 112 determining the number of blocks and the location of each block based on at least one of the number of energized heat elements 136, the voltage of the battery 130, the temperature of the heat elements 136, and the temperature detected by the ambient temperature detector 123, the processor load for controlling the pulse timing and pulse width can be reduced.

As shown in FIG. 3 (A), the current control unit 112 determines the boundaries between blocks so that there is an equal number of energized heat elements 136 in each block of heat elements 136 in the thermal head 134. The number of energized heat element 136 can be calculated in dot line units based on the data written to the line buffer 126. When there are six energized heat elements 136 and two blocks as shown in a typical example in FIG. 3 (A), three energized heat elements 136 are allocated to each of block B1 and block B2.

The difference in the number of heat elements 136 allocated to each block is preferably within a specific range. More specifically, the difference (Δn, a specific value) in the number of heat elements 136 in the block with the most energized heat elements 136 and the block with the fewest energized heat elements 136 is preferably within 10% of the number of heat elements 136 in the smallest block, more preferably within 5%, and even more preferably within 1%. If the number of heat elements 136 allocated to a block can be set in units of 1, the blocks are ideally grouped so that Δn is 1 or 0.

By thus creating the blocks, the difference in heat output per unit time in each block of the thermal head 134 will be within a specific range. Because the difference in heat output in each block is small, there is no need to control the pulse width and timing individually for each block, and processing can be simplified.

The current control unit 112 may also segment the thermal head 134 into heat elements 136 so that the difference in heat output per unit time in each block of the thermal head 134 will be less than a specific value. This specific value may be preset based on the difference in heat output per unit time in each block, for example. In this event, the current control unit 112 gets the difference in heat output per unit time in each block based on the boundary between blocks of the thermal head 134 and the number of heat elements 136 in each block. The current control unit 112 determines if the difference in heat output between the block with the greatest and the block with the lowest heat output per unit time is less than a specific value, and changes the boundary between blocks and the number of heat elements 136 if the difference is greater than or equal to the specific value. As a result, the thermal head 134 is segmented into blocks so that the difference in the heat output per unit time in each block is less than the specific value.

The specific value (ΔH) that is set for evaluating the heat output can be set referenced to the heat output of the block with the lowest heat output, or the average or median heat output per unit time of all blocks. More specifically, the specific value is preferably 10% of the reference, further preferably 5%, and yet further preferably 1%.

Because the difference in the heat output of the blocks is small, there is no need to individually control the pulse width and timing for each block, and processing is simplified. The specific value (ΔH) that is set for evaluating the heat output can also be set referenced to the rated heat output of the thermal head 134. In this case, the specific value is preferably 10% of the rated heat output, further preferably 5%, and yet further preferably 1%.

The specific values (Δn, ΔH, for example) that are preset for the difference in the number of heat elements 136 in each block, and the difference in the heat output per unit time of each block, may be stored in ROM (not shown in the figure) of the control unit 110, for example.

Figure 5:
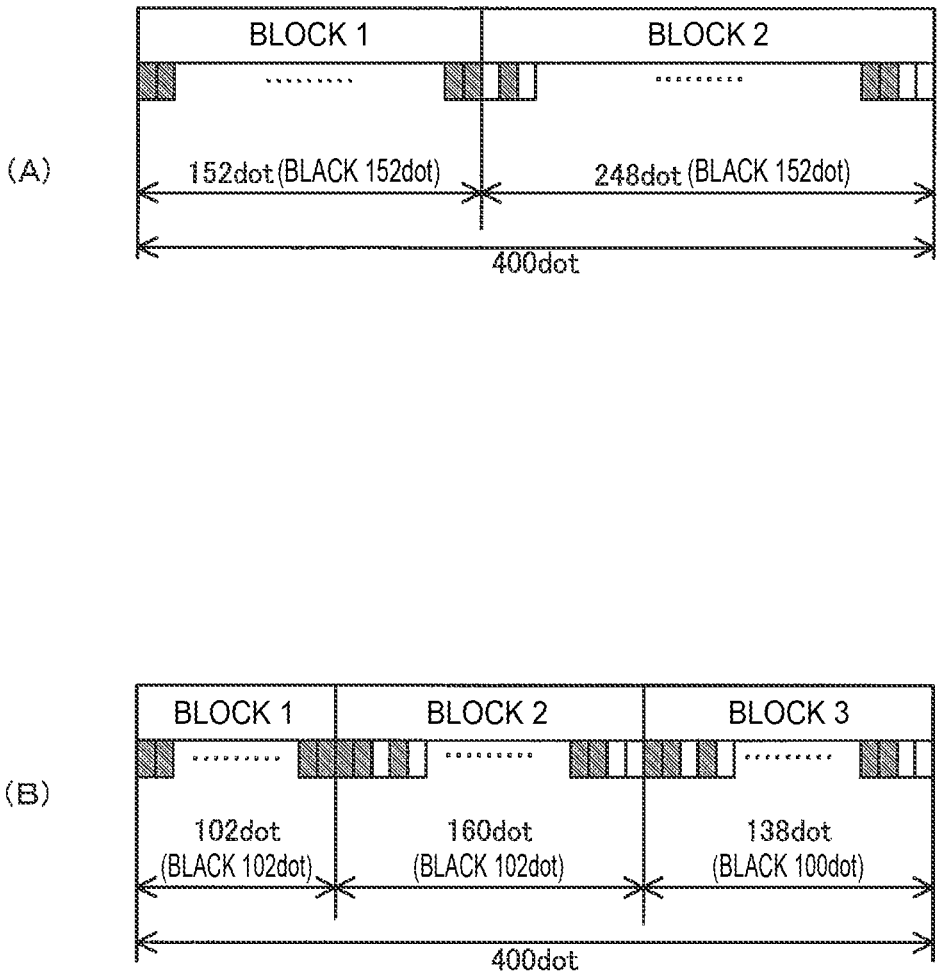
FIG. 5 illustrates the process dividing the thermal head into blocks.

A more specific example is shown in FIG. 5. FIG. 5 illustrates the process whereby the current control unit 112 segments the thermal head 134 into blocks, FIG. 5 (A) showing an example of segmenting the thermal head 134 into two blocks, and FIG. 5 (B) showing an example segmenting the thermal head 134 into three blocks.

In the example in FIG. 5 (A), the thermal head 134 has 400 heat elements 136 equal to 400 dots. Based on the data written to the line buffer 126, the current control unit 112 calculates the number of heat elements 136 (304 dots) that are energized in the group of 400 heat elements 136. The current control unit 112 then gets the number of blocks (2). The current control unit 112 then determines the boundary between blocks 1 and 2 so that the number of heat elements 136 that are energized is substantially equal. In the example in FIG. 5 (A), the heat elements 136 for 152 dots are allocated to block B1, and the heat elements 136 for 248 dots are allocated to block B2, but the number of energized heat elements 136 in each block is the same. As a result, printing with no difference in density is possible by the current control unit 112 applying pulses of the same pulse width from the drive circuit 142 to block B1 and block B2.

In the example in FIG. 5 (B), the thermal head 134 segments the thermal head 134 into three blocks respectively having 102, 102, and 100 heat elements 136 that are energized. This results in the greatest difference in the number of energized heat elements 136 being 2. However, referenced to block 3, which has the fewest number of heat elements 136 that are energized, this difference is 2%, which is within a good range. Note that the number of energized heat elements 136 may be 102 dots in block B1, 101 dots in block B2, and 101 dots in block 3 in this example.

When the number of energized heat elements 136 allocated to each block is substantially equal as in this example, the width of pulses applied to each block, and the interval between pulses, can be the same as shown in FIG. 4 (A). Because the need to consider the drop in battery 130 capacity while printing one dot line is small, there is no need to adjust the pulse width and the pulse output timing. The current control unit 112 can therefore determine the pulse width and pulse output timing once for one dot line. As a result, the load of the process controlling the pulse width and the pulse output timing can be reduced, and energizing the heat elements 136 can be controlled with a low load on the processor.

For comparison, an example in which the number of energized heat elements 136 varies block to block is described next.

In the example in FIG. 3 (B), there are four energized heat elements 136 in block B1 and two in block B2. In this case, the current control unit 112 sets the pulse width of the pulses P1 output in block B1 and the pulse width of pulses P2 output in block B2 according to the number of energized heat elements 136 as shown in FIG. 4 (B). In the example in FIG. 4 (B), the paper width of pulses P1 and P3 is greater than the pulse width of pulses P2 and P4. Due to the difference in pulse width, the voltage drop of drive voltage Vh during output to pulses P1 and P3, and the voltage drop in drive voltage Vh during output to pulses P2 and P4, is the difference Δ shown in the figure. Because this voltage difference causes the heat output to differ, the current control unit 112 must calculate the pulse width of pulses P2 and P4 so that the density of the dots 105 is substantially equal despite the effect of the voltage difference Δ. Therefore, in the comparison shown in FIG. 3 (B) and FIG. 4 (B), the appropriate pulse width and the pulse timing must be determined separately for block B1 and block B2, and the processor load is greater than in this embodiment of the invention as shown in FIG. 3 (A) and FIG. 4 (A). In the control method used by the current control unit 112 according to this embodiment, the number of times the process that determines the pulse width and pulse timing is executed to print one dot line is smaller as shown in FIG. 4 (A). More specifically, the number of iterations of the process is 1/n times the comparison where n is the number of blocks, and the load on the processor is low. This embodiment of the invention can therefore efficiently control pulse output by a low-load process.

The number of segments in the thermal head 134, that is, the number of blocks, is determined based on the number of heat elements 136 the current control unit 112 energizes and the remaining capacity of the battery 130.

FIG. 6 is used to describe the process whereby the current control unit 112 segments the thermal head 134. As shown in FIG. 6, the maximum number of heat elements 136 that can be energized (the number of simultaneously energized dots) at the same time is set in the current control unit 112 relationally to the voltage of the battery 130. The set content is stored, for example, in memory 125 or ROM (not shown in the figure) of the control unit 110.

The amount of power that the battery 130 can supply depends on the remaining battery 130 capacity, and can be determined from the end voltages of the battery 130. In the settings in FIG. 6, the number of simultaneously energized dots is defined relative to a representative battery 130 voltage. If the voltage detected by the battery management unit 122 is between representative values such as shown in FIG. 6, the current control unit 112 uses the number of simultaneously energized dots corresponding to the voltage that is lower than the detected voltage.

The current control unit 112 counts (calculates) the number of energized heat elements 136 in the thermal head 134 based on the data in the line buffer 126. The current control unit 112 then gets the number of blocks by dividing the number of energized heat elements 136 by the number of simultaneously energized dots obtained from FIG. 6. More specifically, the current control unit 112 determines the number of blocks (number of segments) so that the number of energized heat elements 136 contained in one block is less than or equal to the number of simultaneously energized dots. Because the number of heat elements 136 appropriate to the amount of power that the battery 130 can supply are energized by a single pulse application, dots 105 of sufficient density can be formed. For example, if the battery 130 voltage is greater than or equal to 7.5 V and less than 8.0 V, the number of simultaneously energized dots is 150 dots. Because the number of energized heat elements 136 in one block is less than or equal to the number of simultaneously energized dots, the number of segments when the number of energized heat elements 136 is 150 dots or less is one, and the number of segments is two when the number of energized heat elements 136 is greater than 150 dots and less than or equal to 300 dots. The number of segments is three when the number of energized heat elements 136 is greater than 300 dots and less than or equal to 450 dots.

While not shown in FIG. 6, the number of simultaneously energized dots may be set according to the ambient temperature of the battery 130 detected by the ambient temperature detector 123. More specifically, the number of simultaneously energized dots may be set relationally to the battery 130 voltage and the temperature detected by the ambient temperature detector 123. As known from the literature, the charge-discharge characteristic of may primary batteries and storage batteries changes with temperature. As a result, if the temperature detected by the ambient temperature detector 123 is also considered to set the number of simultaneously energized dots, the thermal head 134 can be segmented to more accurately reflect the capacity of the battery 130. More specifically, because a number of heat elements 136 near the upper limit of the battery 130 capacity can be energized by one pulse application, printing is more efficient.

The number of simultaneously energized dots may also be set based on the conveyance speed of the thermal roll paper 102. More specifically, the number of simultaneously energized dots may be set relationally to the battery 130 voltage and the conveyance speed of the thermal roll paper 102. This setting may also be related to the temperature detected by the ambient temperature detector 123. If the conveyance speed of the thermal roll paper 102 is fast, the drop in the drive voltage Vh of the heat elements 136 is preferably suppressed and the heat output per unit time of the heat elements 136 is increased. One method of setting the number of simultaneously energized dots based on the conveyance speed may divide the conveyance speed into three ranges, high, normal, and low, set the number of dots energized simultaneously when the conveyance speed is high lower than when the conveyance speed is normal, and set the number of simultaneously energized dots when the conveyance speed is low higher than when the conveyance speed is normal. This enables printing with good quality at different conveyance speeds even when the remaining battery 130 capacity is low.

Figure 7:
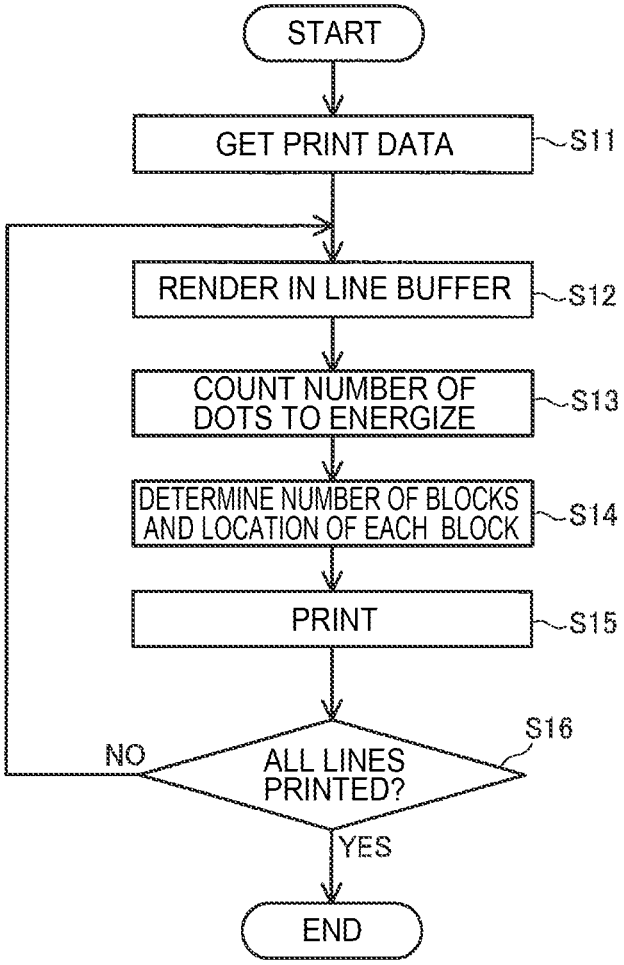
FIG. 7 is a flow chart of printer operation.

FIG. 7 is a flow chart of printer 100 operation, and shows the operation for printing based on print data sent from the host computer 200.

When print data is sent from the host computer 200, the print control unit 111 gets and stores the print data in memory 125 (step S11). Next, the print control unit 111 reads data for one line of the print data from memory 125, and renders it in line buffer 126 (step S12).

Based on the data written to the line buffer 126, the current control unit 112 counts the number of energized heat elements 136 (number of dots) in the heat elements 136 of the thermal head 134 (step S13).

The current control unit 112 then determines the number of segments in the thermal head 134 and where to divide the segments based on the number of heat elements 136 counted, the battery 130 voltage detected by the battery management unit 122, and the number of simultaneously energized dots shown for example in FIG. 6 (step S14). The current control unit 112 may also execute step S14 after controlling the battery management unit 122 to detect the voltage of the battery 130.

The printing operation is then executed by the print control unit 111 and current control unit 112 (step S15). In step S15, the print control unit 111 controls the drive circuit 141 to convey the thermal roll paper 102 while the current control unit 112 controls energizing the thermal head 134. The current control unit 112 drives the drive circuit 142 and outputs pulses to the heat elements 136 according to the data rendered in line buffer 126.

The print control unit 111 determines whether or not all lines of print data stored in memory 125 have been printed (step S16). If all lines were printed (step S16 returns YES), the process ends. If there is a line that has not been printed (step S16 returns NO), control goes to step S12 and the next line is printed.

As described above, the printer 100 according to this embodiment prints on thermal roll paper 102 based on print data. The printer 100 has a thermal head 134 with multiple heat elements 136 disposed in the sub-scanning direction CR perpendicular to the conveyance direction F of the thermal roll paper 102. The printer 100 also has a current control unit 112 that segments the thermal head 134 into plural blocks, and controls the timing for energizing the heat elements 136 block by block. The current control unit 112 segments the thermal head 134 into plural blocks based on the print data so that the difference in the number of energized heat elements 136 in a first block and a second block is within a specific range. As a result, a control method that suppresses the number of simultaneously energized heat elements 136 by applying current in block units does not need to adjust the energize timing block by block, and control can be simplified. The processor load can therefore be reduced, delays from processing can be prevented, and throughput can be improved.

Furthermore, because the current control unit 112 groups the heat elements 136 into blocks so that the difference in the heat output per unit time in a first block and a second block is within a specific range, the difference in heat output between blocks is small, and controlling the energize timing can be further simplified.

The current control unit 112 also groups the heat elements 136 into blocks based on at least one of the drive voltage applied to the heat elements 136, the conveyance speed of the thermal roll paper 102, and the temperature of the heat elements 136. As a result, the process of creating blocks of heat elements so that the difference in heat output in each block is small can be simplified.

The printer 100 also has a battery 130, and a battery management unit 122 that detects at least one of the remaining battery 130 capacity and the ambient temperature of the battery 130. The drive circuit 142 applies pulse current to the heat elements 136 in block units based on the current output of the battery 130. As a result, when the power that can be supplied to the heat element 136 is limited by the capacity of the battery 130, energizing the heat elements 136 can be appropriately controlled, enabling consistent printing.

The current control unit 112 also determines the number of blocks based on at least one of the remaining battery 130 capacity detected by the battery management unit 122 and the ambient temperature of the battery 130. As a result, controlling the pulse width and energize timing of the pulses applied to the heat elements 136 can be achieved by a process with a low processor load.

The current control unit 112 also determines the number of blocks based on the detector output of the battery management unit 122 and the number of energized heat elements 136. As a result, energizing the heat elements 136 can be appropriately controlled by a process with a low processor load.

The thermal head 134 is a line head having a number of heat elements 136 equal to at least one dot line printed on the thermal roll paper 102. The printer 100 has a line buffer 126 that stores print data for at least one dot line in dot line units. Based on the print data stored in the line buffer 126, the current control unit 112 determines which of the heat elements 136 in the thermal head 134 will be energized. As a result, the heat elements 136 of the thermal head 134 that will be energized can be quickly determined, and the heat elements 136 of the thermal head 134 can be efficiently divided into blocks. High quality printing can be achieved by creating blocks appropriately to the printed data.

The current control unit 112 in this embodiment of the invention may apply a sampling process to the print data stored in the line buffer 126. This sampling process is a process that reduces the number of dots in the print data for one dot line stored in the line buffer 126. By applying a sampling process, the current control unit 112 reduces the number of heat elements 136 energized based on the print data stored in the line buffer 126. By reducing the number of energized heat elements 136 through the sampling process, the number of blocks into which the current control unit 112 segments the thermal head 134 is reduced.

When the number of energized heat elements 136 is large relative to the number of simultaneously energized dots shown in FIG. 6, the number of blocks increases in the process whereby the current control unit 112 determines the number of blocks in the thermal head 134 and where the blocks are separated. For example, to avoid creating too many blocks in one dot line, an upper limit may be set for the number of blocks into which the current control unit 112 segments the thermal head 134. By applying the sampling process in this case, printing is possible using a number of blocks that is equal to or less than the upper limit even if the number of dots in the print data stored in the line buffer 126 is large relative to the number of simultaneously energized dots. More specifically, the number of blocks in the thermal head 134 can be kept less than or equal to the upper limit even if the number of simultaneously energized dots is small because the voltage or remaining capacity of the battery 130 is low.

A specific example of processing by the current control unit 112 when the sampling process can be executed is described next.

After determining the number of blocks and the location of each block in the thermal head 134 in step S14 in FIG. 7, the current control unit 112 determines if the number of blocks exceeds the upper limit. If the number of blocks is less than or equal to the upper limit, the process in FIG. 7 proceeds. If the number of blocks exceeds the limit, the sampling process is run to reduce the number of dots in the print data stored in the line buffer 126. Control then returns to step S13 after the sampling process to count the number of dots to energize and determine the number of blocks and locations in step S14.

The invention is not limited to the embodiments described above, and can be modified and improved in many ways without departing from the scope of the accompanying claims.

For example, a thermal printer that uses thermal roll paper 102 as the print medium is described as an example of the printer 100 in the foregoing embodiment, but the print medium may be cut-sheet media cut to a fixed size or continuous sheet media. The sheet media may have a coated surface, and any desired specific form.

The foregoing embodiment describes a configuration that segments all heat elements 136 of the thermal head 134 into blocks for energizing control, but the invention can also be applied to implementations that limit the number of heat elements 136 that are used. More specifically, when printing on thermal roll paper 102 that is narrower than the printable width of the thermal head 134, the set of heat elements 136 that are used in the set of all heat elements 136 in the thermal head 134 may be limited to the size of the thermal roll paper 102. In this event, the current control unit 112 may segment only that subset of heat elements 136 that are used for printing into plural blocks for control.

The invention is also described above using an example in which the thermal head 134 has one line of heat elements 136 and one heat elements 136 forms one dot on the thermal roll paper 102, but the invention is not so limited. For example, the thermal head 134 may have plural lines of heat elements 136, and the current control unit 112 may control segmenting the heat elements 136 into plural blocks widthwise based on the print data for the number of lines in the thermal head 134. Furthermore, the invention can also be used when plural heat elements 136 form one dot on the thermal roll paper 102, in which case the current control unit 112 controls creating blocks and energizing based on the number of heat elements 136.

The invention can also be applied to multifunction devices having an internal print unit configured similarly to the printer 100 described above.

The function blocks shown in FIG. 1 can also be desirably embodied by the cooperation of hardware and software, and do not suggest a specific hardware configuration. Furthermore, a control method for controlling a printer 1 by the functions of the print control unit 111 and current control unit 112 by the control unit 110 executing a program stored on an external connected storage medium, and other detailed aspects of the embodiment can be achieved as desired without departing from the scope of the accompanying claims.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing device that prints on print media based on print data, comprising:

a thermal head having multiple heat elements with the heat elements arrayed in a direction perpendicular to the conveyance direction of the print medium; and a control unit that divides the thermal head into plural blocks and controls the energize timing of the heat elements in each block based on the number of heat elements energized among the heat elements of the thermal head;

wherein the control unit divides the thermal head into the plural blocks so that the difference in the number of heat elements that are energized in a first block and a second block included in the plural blocks is less than a specific number.

2. The printing device described in claim 1, wherein:

the control unit segments the heat elements into blocks so that the difference in the heat output per unit time between the first block and the second block is less than a specific heat output per unit time.

3. The printing device described in claim 1, further comprising:

a battery;

the control unit segments the thermal head into blocks based on at least one of a voltage of the battery and a temperature of the battery.

4. The printing device described in claim 1, wherein:

the control unit segments the thermal head into blocks based on at least one of the voltage applied to the heat elements, the conveyance speed of the print medium, and the temperature of the heat elements.

5. The printing device described in claim 3, further comprising:

a battery management unit that detects at least one of the remaining battery capacity and the ambient temperature of the battery; and a drive unit that applies pulse current to the heat elements in block units based on the current output of the battery.

6. The printing device described in claim 5, wherein:

the control unit determines the number of blocks based on the detected output of the battery management unit, and the number of heat elements energized among the heat elements of the thermal head.

7. The printing device described in claim 1, wherein:

the thermal head is a line head having heat elements equal to at least one dot line printed on the print medium;

a line buffer stores at least one dot line of print data in dot line units; and the control unit identifies which of the heat elements of the thermal head are energized based on the print data stored in the line buffer.

8. A control method of a printing device having a thermal head with multiple heat elements arrayed in a direction perpendicular to the conveyance direction of the print medium, and printing on the print medium based on print data, comprising:

controlling dividing the thermal head into plural blocks and controlling the energize timing of the heat elements in each block based on the number of heat elements energized among the heat elements of the thermal head;

wherein the controlling comprises dividing the thermal head into the plural blocks so that the difference in the number of heat elements that are energized in a first block and a second block included in the plural blocks is less than a specific number.

9. The control method of a printing device described in claim 8, further comprising:

segmenting the heat elements into blocks so that the difference in the heat output per unit time between the first block and the second block is less than a specific heat output per unit time.

10. The control method of a printing device described in claim 8, further comprising:

applying pulse current to the heat elements in block units based on a current output of a battery; and segmenting the thermal head into blocks based on at least one of a voltage of the battery and a temperature of the battery.

11. The control method of a printing device described in claim 8, further comprising:

segmenting the heat elements of the thermal head into blocks based on at least one of the voltage applied to the heat elements, the conveyance speed of the print medium, and the temperature of the heat elements.

12. A storage medium storing a program enabling a control unit to execute the control method of claim 8.

* * * * *